US005752617A

United States Patent [19]

Yung

[11] Patent Number: 5,752,617

[45] Date of Patent: May 19, 1998

[54] MATERIAL HOLDING TANK WITH DIKE AND SKIRT

[76] Inventor: Michael J. Yung, 5322 SE. 136th Ave., Portland, Oreg. 97236

[21] Appl. No.: 367,095

[22] Filed: Dec. 29, 1994

[51] Int. Cl.[6] ..... B65D 90/24; B65D 90/06; B65D 90/12

[52] U.S. Cl. ..... 220/571; 220/4.12; 220/426; 220/469; 220/565

[58] Field of Search ..... 220/571, 562, 220/565, 4.12, 567, 426, 469

[56] References Cited

U.S. PATENT DOCUMENTS

| | | | |
|---|---|---|---|
| 1,674,842 | 6/1928 | Sparks | 220/565 X |
| 1,747,840 | 2/1930 | Patterson | 220/565 |
| 2,050,521 | 8/1936 | Chapin . | |
| 2,074,523 | 3/1937 | Thwaits . | |
| 2,289,913 | 7/1942 | Joor, Jr. | 220/565 |
| 2,531,159 | 11/1950 | Rowell . | |
| 3,358,616 | 12/1967 | Brodhead | 220/562 X |
| 4,245,748 | 1/1981 | Kvamsdal | 220/901 X |
| 4,561,292 | 12/1985 | Pugnale et al. | 220/426 X |
| 4,690,180 | 9/1987 | Gold | 141/51 |
| 4,862,909 | 9/1989 | Kim | 137/150 |
| 4,871,081 | 10/1989 | Ershig | 220/565 |
| 4,895,272 | 1/1990 | De Benedittis et al. | 220/565 X |
| 4,936,705 | 6/1990 | Schneider | 220/426 X |
| 4,955,956 | 9/1990 | Gerhard | 220/562 |
| 4,960,222 | 10/1990 | Fields, III | 220/571 X |
| 5,071,166 | 12/1991 | Marino | 220/571 X |
| 5,082,034 | 1/1992 | Soper | 220/571 X |
| 5,114,046 | 5/1992 | Bryant | 220/571 X |
| 5,117,997 | 6/1992 | Fink | 220/555 X |
| 5,201,435 | 4/1993 | Harding et al. | 220/571 X |
| 5,249,698 | 10/1993 | Cruver et al. | 220/565 |
| 5,253,777 | 10/1993 | Schutz | 220/571 |
| 5,273,318 | 12/1993 | Whatley, Jr. | 220/565 |
| 5,285,914 | 2/1994 | Del Zotto | 220/571 X |
| 5,323,903 | 6/1994 | Bush et al. | 220/571 X |
| 5,333,752 | 8/1994 | Harding, Jr. | 220/565 |
| 5,346,093 | 9/1994 | De Benedittis et al. | 220/565 |
| 5,400,924 | 3/1995 | Brodie | 220/571 X |
| 5,421,478 | 6/1995 | Lovato | 220/565 |
| 5,589,631 | 12/1996 | Spring et al. | 220/426 X |

FOREIGN PATENT DOCUMENTS

| | | | |
|---|---|---|---|
| 1577510 | 8/1969 | France | 220/567 |
| 794129 | 1/1981 | U.S.S.R. | 220/565 |
| 2262302 | 6/1993 | United Kingdom | 220/565 |

*Primary Examiner*—Sue A. Weaver

*Attorney, Agent, or Firm*—Klarquist Sparkman Campbell Leigh & Whinston, LLP

[57] ABSTRACT

A material containment system is described that generally includes a containment tank, a skirt that is coupled to, supported by and extends outwardly from the tank, and a dike which defines a chamber for receiving the contents of the tank should such contents leak or otherwise be expelled from the tank. A tank stand optionally may be placed inside the chamber for receiving and supporting the tank. The skirt is spaced from the dike and extends beyond the periphery of the chamber so that substances contacting the skirt, such as rain, are guided away from the chamber. The system also may include at least one, and often plural, releasable tank fasteners that releasably couple the tank to the dike. The tank typically is a single-walled tank. Alternative embodiments include a double-walled tank, and a tank that has an upper double-walled portion and a lower single-walled portion. With double-walled embodiments, a space is defined between the two walls which may be filled with a material such as an antifreeze, a coolant or an insulating material. The system preferably is transportable, and may include laterally spaced parallel brackets coupled to a bottom portion of the dike for receiving the tines of a lift truck. The tank also may include a fastening device for coupling the tank, and possibly the skirt, to a crane-type lifting device.

14 Claims, 4 Drawing Sheets

MATERIAL HOLDING TANK WITH DIKE AND SKIRT

FIELD OF THE INVENTION

This invention concerns material containment systems. More specifically, the invention is directed to above-ground open dike containment systems for storing liquids.

BACKGROUND OF THE INVENTION

A number of containment systems have been developed for containing waste or hazardous materials. One example of a material storage system is described in U.S. Pat. No. 4,862,909 to Kim. The Kim system includes a drainage pan for catching materials that leak from a storage tank. This feature also is shown in U.S. Pat. No. 2,050,521 to Chapin.

Both the Kim and the Chapin devices suffer from several disadvantages. For instance, substances contacting these containment systems from above, such as rain water, would be collected in drainage compartments and would typically have to be analyzed to see if they contain hazardous waste. Also, rain water would mix with leaking waste from the storage tanks of these devices in the drainage compartment, thereby increasing the volume of material requiring costly processing in accordance with environmental regulations. The Chapin device exacerbates this problem by guiding substances contacting the storage tank from above directly into the basin.

Some material containment systems completely encase a storage tank in a surrounding structure and thus are not open dike systems. U.S. Pat. No. 5,333,752 to Harding describes a closed system having an inner tank which is inserted into and closes an outer drainage tank. As another example, U.S. Pat. No. 5,285,914 to Del Zotto teaches encasing tanks containing flammable materials in a concrete structure in that thick concrete walls completely surround the storage tank. Del Zotto's system is not transportable. Furthermore, the material costs associated with manufacturing the device are prohibitive. Also, because these systems are closed, fumes from materials leaking from the tanks can build up within the tank enclosure.

SUMMARY OF THE INVENTION

The present material containment system addresses the problems associated with the prior art systems described above. In general, the system is preferably an open dike system. That is, the system preferably includes a tank positioned above or in a dike or drainage collection tank which is open to the atmosphere. The system includes a tank skirt that is coupled to a storage tank to substantially prevent substances, other than those which may leak from the tank, from entering the dike. The term tank skirt refers to a diverter, which may be of any shape in its broadest aspect, which is configured to shield the upper end of the dike from rain or the like and to divert the rain away from the dike. To provide an open dike system in the preferred embodiment, a gap is provided between the tank skirt and the dike.

More specifically, one embodiment of the present invention includes a storage tank and a tank skirt that is supported by and extends outwardly from the tank. In certain embodiments, the skirt is connected to the tank so as to seal the interconnection between the tank and skirt to prevent substances contacting the upper portion of the tank from passing between the tank and the skirt. In this embodiment, the dike defines a collection chamber which has an upper peripheral opening. The dike is positioned beneath and/or receives the tank such that the collection chamber can receive the contents of the tank in the event the tank leaks. The tank skirt typically is supported by and extends outwardly from the tank and beyond the periphery of the dike so that substances contacting the skirt from above, such as rain, cannot enter the collection chamber. A tank stand may be used to receive and support the tank inside the collection chamber.

The system also may include at least one, and most preferably, plural, releasable tank fasteners. The fasteners may take many forms and releasably couple the tank to the dike and/or tank stand. Consequently, the tank may be readily separated from the dike to allow independent replacement or repair of either the tank or the dike. Also, installation is facilitated as one need not move the tank and dike as a unit. The fasteners help secure the tank against movement relative to the tank stand and dike, for example if the dike fills with liquid which would otherwise tend to float the tank.

In a first embodiment, the tank is optionally a single-walled tank. An alternative embodiment of the invention includes a double-walled tank, or a tank that has a double-walled upper portion (above the skirt) and a single-walled lower portion. The double-walled portion includes first and second spaced-apart walls. This space may be filled with a variety of materials, such as an antifreeze material that reduces the formation of condensation within the double walled space of the tank.

The system also preferably is transportable from one location to another. One embodiment of an easily transportable system includes plural spaced-apart substantially parallel brackets that are coupled to the underside of the floor of the dike. These brackets may be hollow and sized to receive the tines of a lift truck for use in moving the system from one location to another. Reinforcing or wear plates are typically mounted to the dike between the brackets to protect the dike from inadvertent rupture when it is being moved. The tank also may include a lifting bracket for use in removing the tank, and typically a supported skirt, by a crane or the like.

When the system is assembled, the skirt is preferably spaced from an upper edge of the dike. This spacing is sufficient to allow vapors to escape from the dike, thereby alleviating the potential hazards associated with containing volatile materials in a closed system. The spacing also may be sufficient to allow access to the collection chamber without requiring the removal of the tank or skirt.

An optional ladder and platform which may be slidable along the periphery of the dike, may be provided to facilitate access to the top of the tank. In addition, a conduit may be connected from the tank to the periphery of the dike through which fluid from the tank may be pumped.

DETAILED DESCRIPTION OF THE PREFERRED EMBODIMENTS

Figure 1:
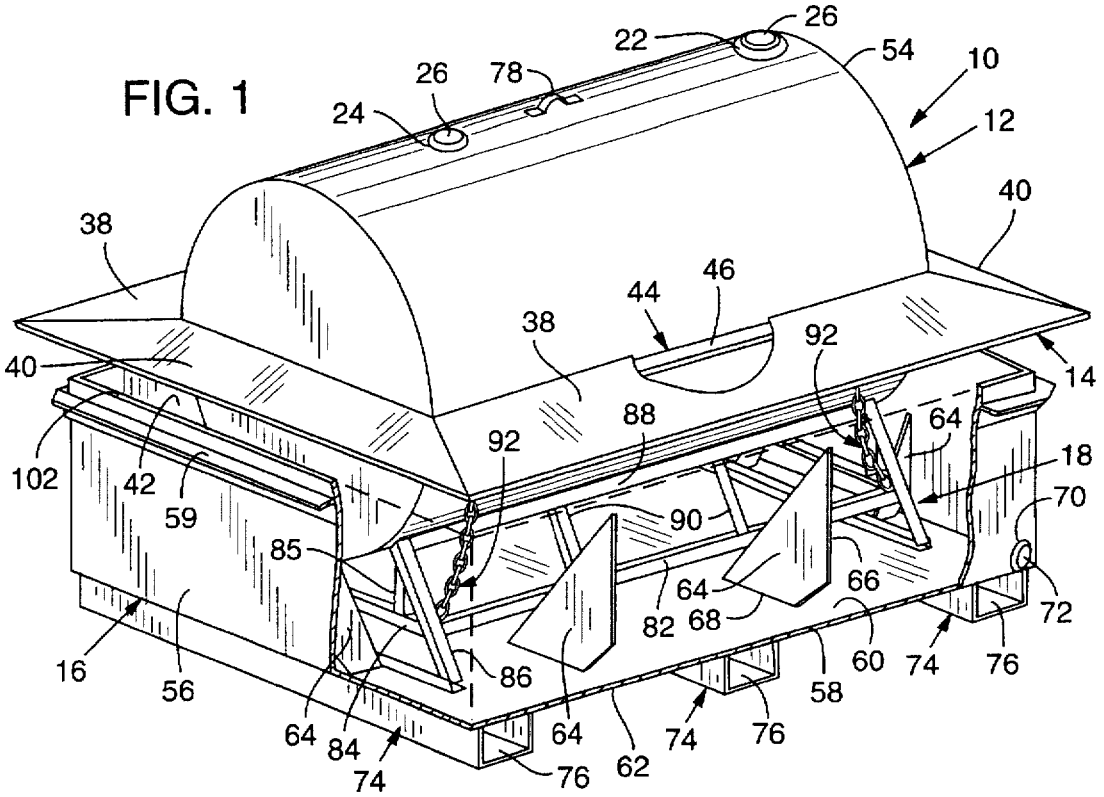
FIG. 1 is a partially broken away isometric view of one embodiment of an apparatus according to the present invention.

FIG. 1 illustrates one embodiment of a material containment system 10 according to the present invention. The illustrated embodiment of containment system 10 includes a storage tank 12, a skirt 14 that extends outwardly from the tank 12, and an open-top dike 16. The containment system 10 may further include a tank stand 18, which is positioned within dike 16 to receive and support tank 12. When assembled, dike 16 is positioned to define a collection chamber which receives any material that leaks from tank 12. The dike chamber preferably, although not necessarily, has sufficient capacity to receive the entire contents of the tank 12 should it rupture.

Each of these components, their interconnection, and additional components of the system will be described in more detail below. First, however, one skilled in the art will realize that system 10 may be manufactured from a variety of materials. Furthermore, each component of the system 10 may be manufactured from a material different from that used to produce the other components. The selection of a material appropriate for constructing containment system 10 will best be decided by considering (1) the nature of the material contained in storage tank 12 (eg., is the material flammable, volatile, toxic, corrosive, etc.), and (2) the material requirements for supporting and storing the contents of tank 12 (eg., how strong, moldable, corrosion resistant, etc. must the material be). Without limitation, materials currently believed suitable for constructing containment system 10 include metals and metal alloys, such as aluminum and stainless steel, polymeric plastic materials, ceramic materials and glass materials. A currently preferred material for constructing the illustrated embodiments of the invention for use in storing petroleum based products is sheet metal, such as 12 gauge steel sheet metal.

One skilled in the art also will realize that the dimensions of the various components of containment system 10 may vary.

Because both the material used to construct system 10 and the dimensions thereof may vary and are not critical features of the invention, the following description of the preferred embodiments generally does not refer to these aspects of the invention. If materials and/or dimensions are stated, such recitation should be considered exemplary only, and should in no way be construed to limit the invention to the particular features described.

A. Containment Tank

Tank 12 may comprise any tank now known or hereinafter developed for containing materials, such as toxic and flammable materials. Tank 12 also may be designed especially for storing liquid or solid materials. The illustrated embodiment of tank 12 depicts a tank designed primarily for storing liquids. Illustrated tank 12 is substantially cylindrical, although the shape of tank 12 is not a critical feature. Other tank shapes, such as spherical or cubic, also are suitable.

Tank 12 most likely will be constructed to meet certain suggested or imposed regulations concerning the performance of the tank. For instance, tank 12 might be constructed to be in compliance with Underwriter Laboratory standard 142, the Standard for Steel Aboveground Tanks for Flammable and Combustible Materials. UL 142 states particular construction and performance standards for storage tanks, including buoyancy tests, hydrostatic load tests and tank support load tests.

As with any storage tank, tank 12 typically includes at least one tank filling orifice 22. Tank 12 also generally includes at least one threaded drain or vent 24. Tank filling orifice 22 and vent 24 may be closed in a conventional manner, such as with a threaded plug 26. Tank 12 may also have an optional lower drain coupled to a conduit 25 (shown in dashed lines in FIG. 2) which is supported at one end by a bracket 27 mounted to the dike 16. A pump (not shown) may be coupled to conduit 25 for use in delivering fuel or other fluid from the tank 12.

Figure 5:
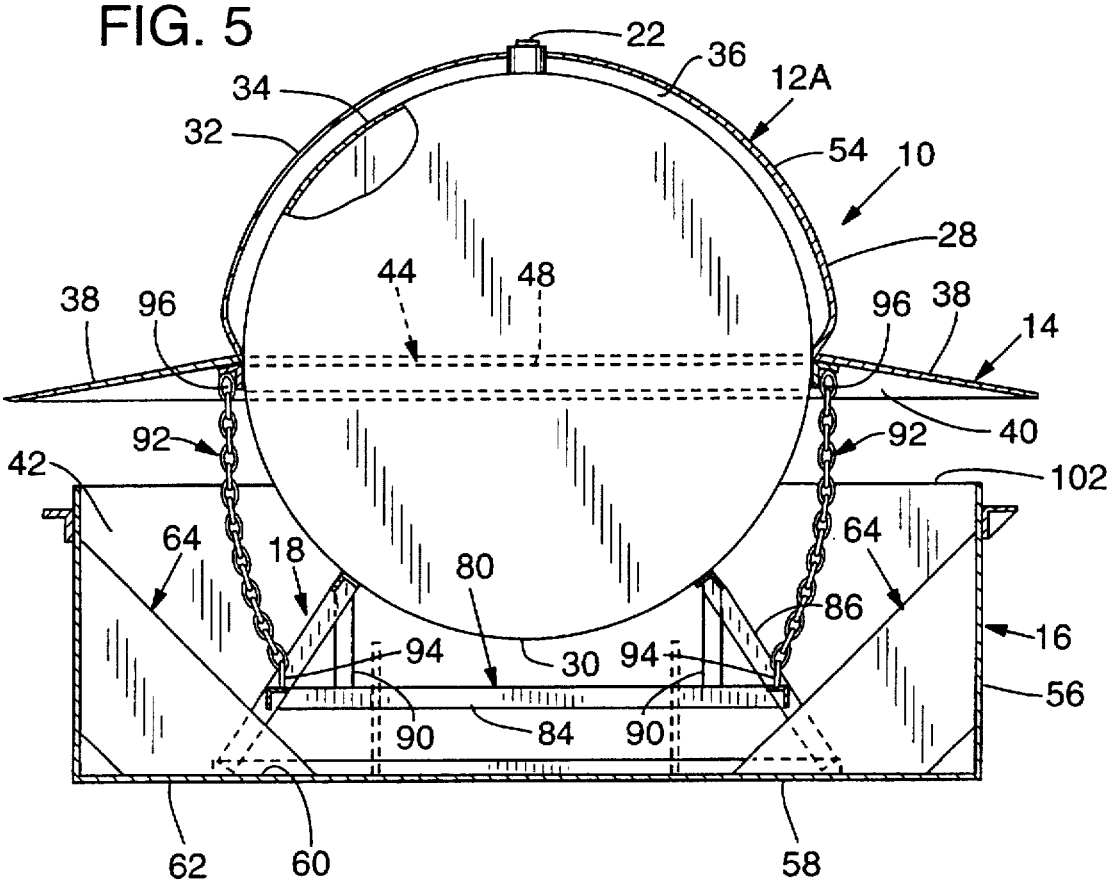
FIG. 5 is a partial sectional end view of an alternative embodiment of the apparatus of FIG. 1 wherein the tank includes a double-walled upper portion.

A single-walled embodiment of tank 12 currently is a preferred embodiment. However, a double-walled tank 12A also may be used as illustrated in FIG. 5. The entire tank 12A may have a double-walled construction, or tank 12A may have an upper double-wall portion 28 and a lower single-walled portion 30. Double-walled portion 28 includes a first wall 32 and a second wall 34 which are spaced one from the other to define a space 36 therebetween. Tank 12A is more expensive and more difficult to manufacture, which is one reason why a single-walled tank 12 is a currently preferred embodiment. Nevertheless, the double-walled tank 12A provides certain advantages relative to the single-walled embodiment. For instance, a double-walled construction increases the strength of the tank, which helps prevent tank ruptures or punctures that would release the contents of the tank 12. Also, by including a double wall above the skirt, the outer wall of the double wall portion will contain material leaking through the inner wall and above the skirt.

Furthermore, space 36 may be filled with a material that aids the overall function of the containment system 10. To reduce the formation of condensation, space 36 may be filled with an antifreeze material. Any antifreeze material currently known or hereinafter developed which can be placed in space 36 may be used as an antifreeze material for the present invention. By way of example only, space 36 might be filled with ethylene glycol, or a composition that includes ethylene glycol. Other materials also may be placed in space 36.

B. Tank Skirt and Skirt Frame

Tank skirt 14 is supported in a position to divert rain water and the like from entering the main collection area of the dike. The skirt may be supported by the dike or an independent support structure, and is coupled to tanks 12 or 12A. The illustrated embodiment of tank skirt 14 has major opposed side portions 38 and opposed end portions 40. Side portions 38 generally are connected to end portions 40, and may be so connected using any suitable means, such as removable fasteners or welding. As illustrated in the figures, sides 38 may be connected to ends 40 to form a substantially rectangular skirt 14. Both side portions 38 and end portions 40 may be angled downwardly, typically in an acute angle relative to a horizontal plane passing through the tank 12. For example, the skirt may be angled downwardly at sixteen degrees relative to horizontal. This facilitates movement of rain or other substances contacting the containment system 10 from above away from the tank 12 and away from the collection chamber 42 defined by the dike 16. The outer periphery of the skirt 14 may have a downturned edge or lip (not shown except as lip 43 in FIG. 7, a one inch vertical lip being a specific example) for reinforcing purposes. Skirt 14 typically is sized to substantially surround tank 12 in a tight, sealing arrangement.

Tank skirt 14 is coupled to tanks 12 or 12A. As used herein, coupled typically means that the skirt 14 is supported in a position, preferably either directly or indirectly, by the tank 12 to extend outwardly from tank 12. Most preferably, the skirt 14 is rigidly connected to the tank 12, such as by welding or less preferably by using permanent or removable fasteners. Direct attachment to the tank 12 is not necessary as long as the skirt 14 operates to divert materials away from chamber 42.

In the illustrated embodiments of the invention, a skirt frame 44 is mounted to tank 12 (or 12A in FIG. 5). Tank skirt 14 is then mounted to the skirt frame 44. Skirt frame 44, which generally is made from angle iron, typically extends substantially around a midsection of the tank 12. Preferably, the skirt frame extends generally in a common horizontal plane around the exterior of the tank. Skirt frame 44 includes major opposed side portions 46 and opposed end portions 48. Side portions 46 may be attached to the end portions 48 to form a continuous skirt support that substantially surrounds the tank 12, such as the substantially rectangular skirt support illustrated in the figures. Skirt frame 44 may first be assembled and then attached to the tank 12. Alternatively, the skirt frame 44 may be attached, as by welding for example, to the exterior of the tank 12 piece-by-piece.

In the illustrated embodiment, tank skirt frame 44 is placed about an exterior midsection portion of the tank 12 so that one leg of the angle iron of the illustrated frame portions 46, 48 abuts the outer surface 54 of tank 12. The abutting leg is then welded to the tank 12, typically intermittently along the length of the frame components 46, 48. The other or projecting leg of the angle iron is typically bent downwardly relative to horizontal to match the angle of the skirt and this provides support to the skirt along its entire upper surface.

With skirt frame 44 in place, tank skirt 14 is then positioned in surrounding relationship about the tank 12 and is supported in this position by the tank skirt frame 44. Tank skirt 14 may simply rest on skirt frame 44, may be attached solely to the tank 12, may be attached solely to the tank skirt frame 44, or may be attached both to the tank 12 and skirt frame 44. This or other coupling of the tank 12 to the skirt 14 can be done by any suitable means, such as by using permanent or removable fasteners (not shown). Alternatively, and in the most preferred embodiment, skirt 14 is rigidly mounted to skirt frame 44, as by welding. The skirt is also typically welded along the entire intersection of the tank and skirt, which forms a seal between the skirt and tank. A seal may be provided in other ways as well.

C. Dike

Figure 2:
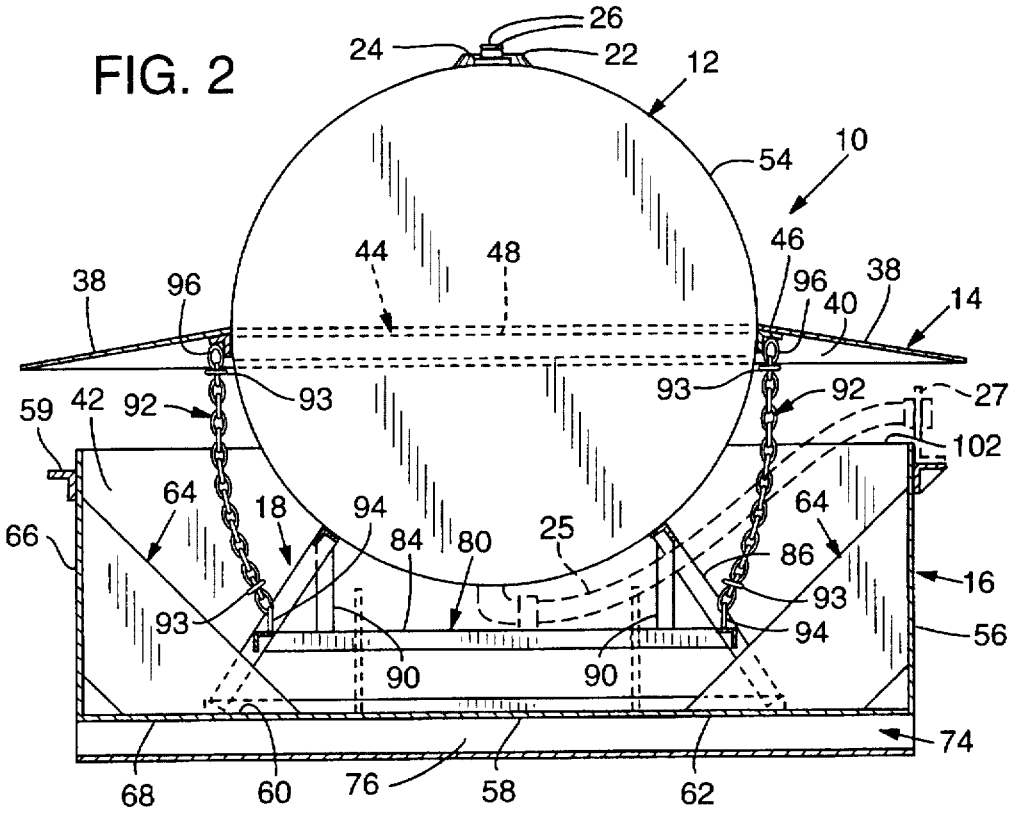
FIG. 2 is an end view of the apparatus shown in FIG. 1 with the front panel of the dike removed to show the structure of one form of a bracket and securing system.
Figure 3:
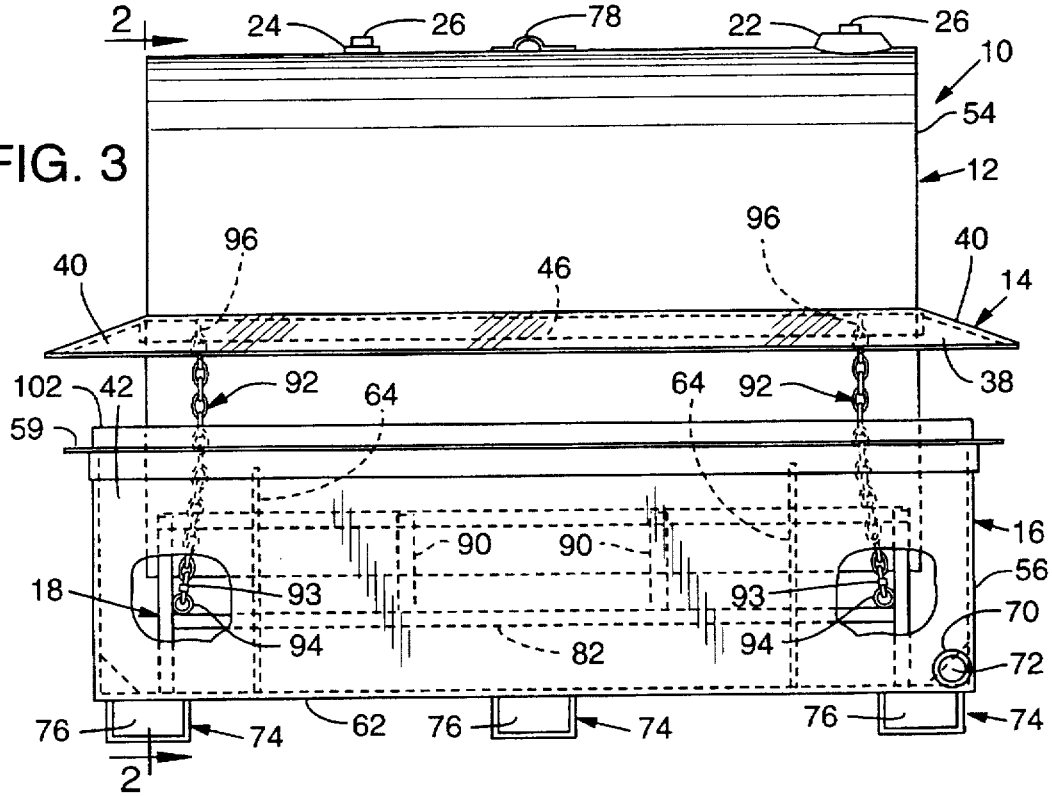
FIG. 3 is a side elevational view of the apparatus of FIG. 1 which further illustrates coupling of fork lift brackets to the system.

Dike 16 is positioned relative to tank 12 so that chamber 42 can receive material which leaks from tank 12. The illustrated dike 16 includes dike sidewalls 56 and dike floor 58. The illustrated floor 58 of dike 16 is a substantially planar structure with top and bottom major planar surfaces 60, 62 (FIG. 2). Dike walls 56 extend upwardly from the floor 58, so that the floor 58 and dike sidewalls 56 collectively define a tank-contents-receiving or collection chamber 42. A reinforcing flange 59 (FIGS. 1–3) is positioned slightly below (e.g. about one inch below) the upper edge of dike walls 56. By positioning the flange in this location, water which may collect on the upper surface of the flange is blocked by the dike walls from being readily blown or carried into the dike. Alternatively, dike 16 may comprise a unitary annular wall 56 that defines chamber 42. The illustrated embodiment of dike 16 is of twelve gauge steel sheets. Dike 16 may be assembled by attaching plural dike walls 56 to floor 58. Any other collection chamber defining dike configuration may also be used.

Reinforcing brackets or gussets 64 also may be used to reinforce the dike 16. The illustrated embodiment of the containment system 10 includes plural gussets 64, each of which is trapezoidal in shape, although other shapes may be used. A side edge 66 of each gusset is attached, such as by welding, to a dike sidewall 56. The opposed side edge 68 of each gusset is attached to dike floor 58.

Dike 16 may include a drain 70 for draining the chamber 42. Drain 70 is typically a threaded aperture which may be closed with a drain cap 72 in a conventional manner.

D. Lifting Brackets

The system 10 preferably is readily transportable from one location to another.

To facilitate movement of the entire system, tank 12 may include laterally spaced parallel brackets 74. Spaced brackets 74 define channels 76 which are sized to receive the tines of a forklift truck for moving system 10 from one location to another. Brackets 74 may be fashioned from the same or a different material than is used to construct dike 16. Brackets 74 are typically made from sheet steel, and are attached in a parallel, laterally spaced-apart orientation to bottom surface 62 of the dike 16. Brackets 74 are secured in place by welding or by using permanent or releasable fasteners (not shown). The brackets 74 also may be formed directly into the floor 58 of dike 16, such as by using a die press. Wear plates, not shown, are typically positioned on the bottom surface 62 and extend between brackets 74 to protect the bottom of the dike from penetration.

The tank 12 also may include a lifting bracket 78. (See FIGS. 1 and 3). Bracket 78 allows the tank 12 to be attached to a crane-type lifting device for moving the tank 12, and the skirt 14 coupled thereto, separately from the dike 16.

E. Tank Stand

Figure 4:
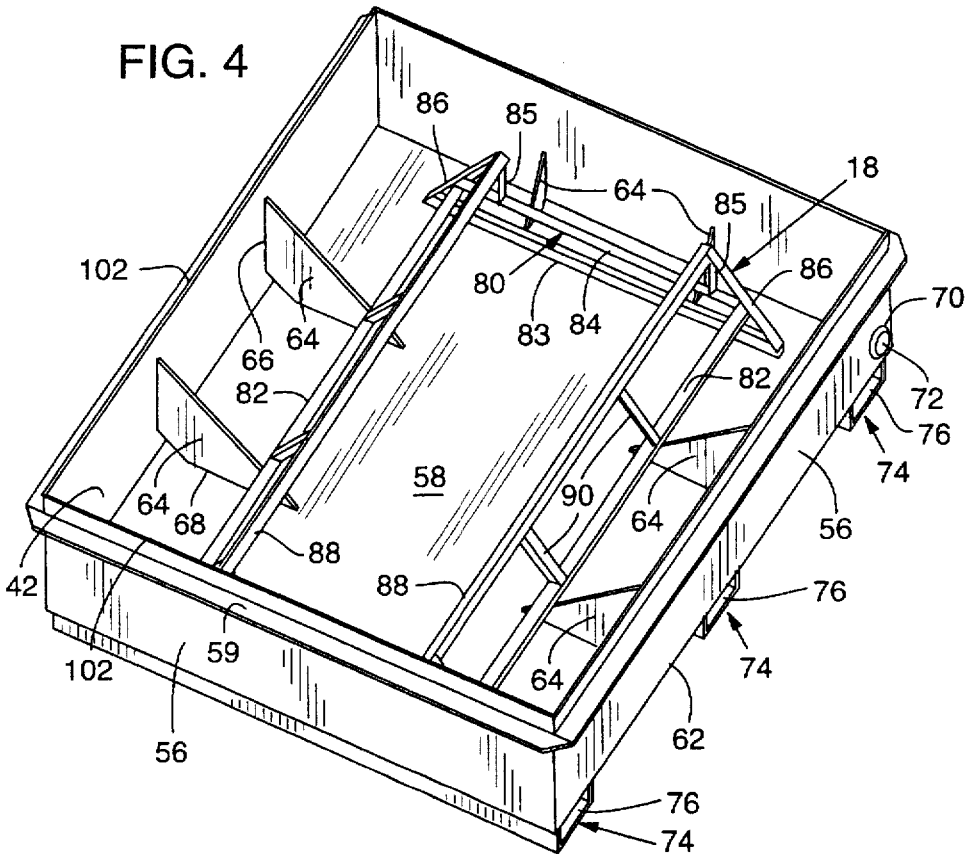
FIG. 4 is a top isometric view of the dike and stand of FIG. 1.

Material containment system 10 also may include a tank stand 18 which is best seen in FIG. 4. Tank stand 18 is positioned within the chamber 42 and rests on top surface 60 of dike floor 58 and is preferably secured, as by welding, to the floor. Tank stand 18 receives and supports the tank 12 within the chamber 42. One skilled in the art will realize that any tank stand 18 capable of supporting tank 12 will suffice for the present invention. Also, a tank may simply rest on the floor of the dike without the use of a tank stand.

The illustrated tank stand includes first and second end sections (one being numbered as 80 in FIG. 4) interconnected by respective side sections which are angled inwardly toward the center of the dike at about thirty to forty-five degrees from vertical. The tank side sections are spaced-apart at their upper ends to form a tank receiving cradle.

The end sections each include a pair of horizontal spaced-apart rails 83, 84 joined at their ends by respective angled side section support members 86. A respective vertical reinforcing brace 85 extends between rail 84 and the upper end of each support member 86. The side sections each include an upper horizontal tank supporting rail 88 and a lower horizontal rail 82. Rails 82, 88 extend between end sections 80 and are secured at their ends to support members 86. Plural braces 90 extend between rails 82, 88.

F. Releasable Fasteners

Tank containment system 10 typically includes at least one releasable fastener, such as the plural chains 92 in the illustrated embodiment, for securing the tank 12 against movement relative to the dike 16 and tank stand 18, such as to prevent tank rotation or uplift. Such fasteners may comprise any fasteners suitable for such function. For instance, suitable fasteners would include straps or other tie-downs, with sufficient strength to resist the movement of the tank 12. The illustrated embodiment of the releasable fasteners comprise plural chains 92, each with a conventional releasable link at each end (e.g. links 93 in FIG. 2) which can be easily and quickly manually released to release the fasteners.

The fasteners 92 couple the tank 12 to the dike 16 or tank stand 18. For example, a first end 94 of the fastener 92 may comprise a link welded or otherwise attached to the tank stand 18 (FIG. 2), with the second end 96 being a link welded or otherwise attached to skirt frame 44. Each link 94 and 96 may be releasably attached to a respective end of an associated chain 92 using a releasable link or any other quick release coupler now known or hereinafter developed.

G. Assembled Containment System

In an illustrated and presently preferred embodiment of the present invention, the containment system 10 includes tank 12, skirt 14, dike 16, tank stand 18 and plural releasable fasteners 92. When assembled, tank 12 is received within the chamber 42 defined by the dike 16. Tank 12 is supported in the chamber by the tank stand 18 so that the skirt 14 is spaced from upper edges 102 of the walls 56 of dike 16. This spacing is sufficient to allow vapors arising from volatile materials in chamber 42 to escape. This distance is also preferably sufficient to allow access to the chamber 42 or to the releasable fasteners 92 therein without moving either the tank 12 or the skirt 14. For example, a six to twelve inch gap is presently preferred. Skirt 14 generally contacts the outermost surface 54 of tank 12, and optionally may be welded thereto, to provide a sealing arrangement between the tank 12 and skirt 14. Skirt 14 is supported by and above the chamber 42 which is bounded by a periphery as defined by the walls 56 of the dike 16. Skirt 14 extends outwardly from the tank 12 and generally beyond the periphery to direct rain and other substances contacting the containment system 10 from above away from the chamber 42.

Figure 6:
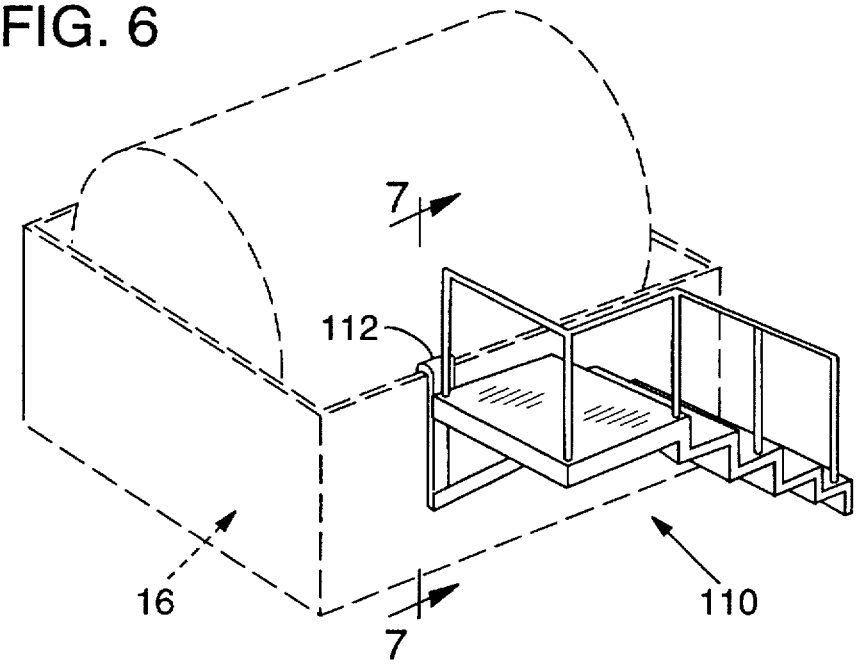
FIG. 6 is an isometric view of a ladder slidably mounted to a dike, with the tank and dike being shown in dashed lines without the skirt and other structure for clarity.
Figure 7:
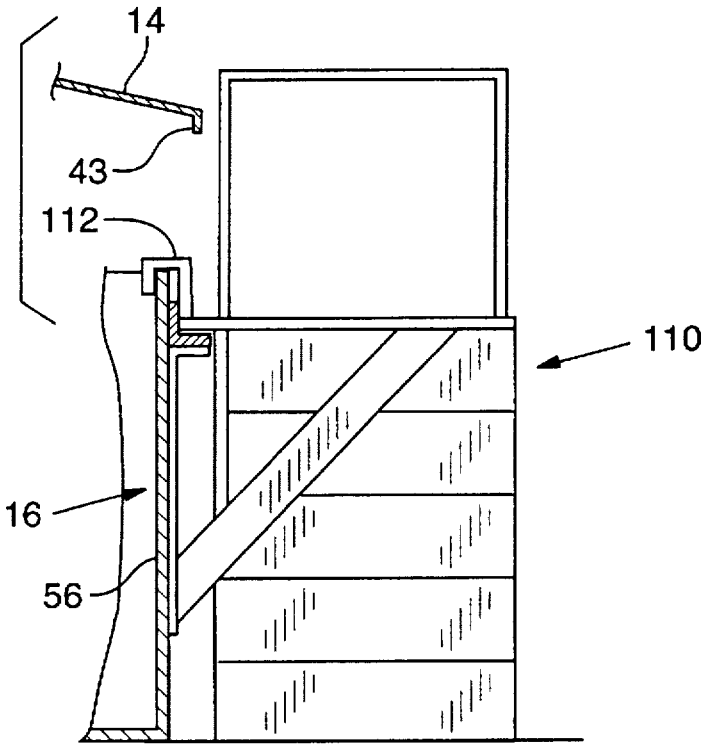
FIG. 7 is an end view of the ladder of FIG. 6.

An optional ladder 110, shown in FIGS. 6 and 7, may be coupled to the dike 16 to facilitate access to the top of the tank. Ladder 110 preferably is slidably coupled to the dike 16, for example by a bracket 112, so that the ladder is easy to move to various locations along the dike wall 56.

Having illustrated and described the principles of the invention in several preferred embodiments, it will be apparent to those skilled in the art that the invention can be modified in arrangement and detail without departing from such principles. I claim all modifications coming within the spirit and scope of the following claims.

I claim:

1. An above-ground material containment system, comprising:

a tank;

a skirt coupled to and extending outwardly from the tank; and a dike having an upper portion, the dike defining a chamber within which at least a portion of the tank is received with a gap being provided between the skirt and at least a portion of the upper portion of the dike, the gap being located between the skirt and the upper portion of the dike and being sized to allow visual and physical access to the chamber whenever the tank is received within the chamber.

2. The system according to claim 1 wherein the dike has an upper opening bounded by a periphery and wherein the skirt extends outwardly from the tank and beyond the periphery, and wherein the gap extends about the entire periphery of the dike, and wherein the dike includes at least one wall having an exterior surface with a flange positioned thereon.

3. The system according to claim 1 wherein the skirt is connected to the tank at a location below a top of the tank and projects outwardly from the tank at such location below the top of the tank.

4. The system according to claim 1 and further including at least one releasable fastener for coupling the tank to the dike.

5. The system according to claim 4 wherein at least one releasable fastener further comprises a chain having at least one releasable link.

6. The system according to claim 1 wherein the tank has an upper double-walled portion and a lower single-walled portion with the upper double-walled portion including a first and second wall that define a space therebetween.

7. The system according to claim 6 wherein the space is filled with an antifreeze material.

8. The system of claim 1 wherein the dike includes interior sidewalls and a floor and at least one reinforcing gusset connected to an interior sidewall and the floor.

9. The system according to claim 1 and further including a tank stand which is positioned within the chamber for supporting the tank.

10. The system according to claim 9 and further including at least one releasable fastener that releasably couples the tank to the tank stand.

11. An above-ground material containment system, comprising:

a tank;

a skirt coupled to the tank; and a dike defining a chamber within which at least a portion of the tank is received, the dike having an upper opening that is bounded by a periphery with the skirt extending outwardly from the tank and beyond the periphery, the upper opening of the dike being spaced a sufficient distance from the skirt to allow visual and physical access to the chamber whenever the tank is received within the chamber.

12. An above-ground material containment system, comprising:

a tank;

a skirt frame coupled to the tank;

a skirt that is coupled to and extends outwardly from the skirt frame and thereby outwardly from the tank;

a dike having an upper opening that is bounded by a periphery, the dike defining a tank-contents-receiving chamber, and wherein the skirt is spaced from the dike and extends beyond the periphery to provide a gap between the skirt and at least a portion of the periphery, the gap sized to allow visual and physical access to the chamber; and a tank stand which is positioned within the chamber for supporting the tank.

13. The system according to claim 12 wherein the tank has an upper double-walled portion and a lower single-walled portion with the upper double-walled portion including a first and second wall that define a space therebetween, the space being filled with an antifreeze material.

14. The system according to claim 12 wherein the dike includes plural laterally spaced parallel bracket on a portion thereof for receiving the fork of a lift truck for moving the system from one location to another and wherein at least one releasable fastener further comprises a chain having at least one releasable link.

* * * * *